US012343581B2

(12) United States Patent
Foley

(10) Patent No.: US 12,343,581 B2
(45) Date of Patent: Jul. 1, 2025

(54) DEVICE FOR REHABILITATION OF APPENDAGES AND JOINTS HAVING MULTIPLE DEGREES OF FREEDOM

(71) Applicant: David Foley, Indianapolis, IN (US)

(72) Inventor: David Foley, Indianapolis, IN (US)

( * ) Notice: Subject to any disclaimer, the term of this patent is extended or adjusted under 35 U.S.C. 154(b) by 143 days.

(21) Appl. No.: 18/492,254

(22) Filed: Oct. 23, 2023

(65) Prior Publication Data

US 2025/0128115 A1 Apr. 24, 2025

(51) Int. Cl.
*A63B 21/008* (2006.01)
*A63B 23/035* (2006.01)

(52) U.S. Cl.
CPC .... *A63B 21/0084* (2013.01); *A63B 23/03508* (2013.01); *A63B 2225/64* (2013.01); *A63B 2225/66* (2013.01)

(58) Field of Classification Search
CPC ..... A63B 21/0084; A63B 23/03508; A63B 2225/64; A63B 2225/66
See application file for complete search history.

(56) References Cited

U.S. PATENT DOCUMENTS 2,956,565 A * 10/1960 Anderson ..... A61D 11/00 607/86
3,055,357 A * 9/1962 Redka ..... A61H 35/006 D24/204
3,286,711 A * 11/1966 MacLeod ..... A61B 17/1355 4/535
4,149,529 A * 4/1979 Copeland ..... A61H 33/02 607/104
4,767,118 A * 8/1988 Ostergard ..... A63B 21/4015 482/79
5,441,477 A * 8/1995 Hargest ..... A61N 1/32 607/104
5,591,221 A * 1/1997 Owens ..... A61F 7/02 36/2.6
5,693,004 A * 12/1997 Carlson ..... A61N 2/02 601/40
6,602,212 B1 * 8/2003 Ahn ..... A61H 33/6057 601/154
7,238,161 B2 * 7/2007 Komkin ..... A61H 15/0092 601/40
10,537,464 B2 * 1/2020 Muehlbauer ..... A61F 7/00
10,646,233 B1 * 5/2020 Everett ..... A61H 9/0007
10,959,483 B1 * 3/2021 Baichu ..... A43B 7/12
(Continued)

*Primary Examiner* — Garrett K Atkinson
(74) *Attorney, Agent, or Firm* — Barrett McNagny LLP

(57) ABSTRACT

A rehabilitation device for exercising a human appendage comprises a housing defining a reservoir and a thermally controllable viscous fluid contained within the reservoir, the thermally controllable viscous fluid having a temperature and a viscosity. The thermally controllable viscous fluid experiences an apparent change in viscosity when exposed to a change in temperature. A heating apparatus is provided for increasing the temperature of the thermally controllable viscous fluid, and a cooling apparatus is provided for decreasing the temperature of the thermally controllable viscous fluid. A temperature control apparatus is provided for selectively increasing or decreasing the temperature of the thermally controllable viscous fluid and thereby decreasing or increasing the viscosity of the thermally controllable viscous fluid.

19 Claims, 12 Drawing Sheets

(56) References Cited

U.S. PATENT DOCUMENTS

| | | | | |
|---|---|---|---|---|
| 2004/0082886 | A1* | 4/2004 | Timpson | A61H 23/02 601/46 |
| 2005/0203447 | A1* | 9/2005 | Pisani | A61H 9/00 601/55 |
| 2006/0207018 | A1* | 9/2006 | Lev | A61H 33/02 4/622 |
| 2008/0038375 | A1* | 2/2008 | Park | A61H 35/006 424/715 |
| 2014/0165284 | A1* | 6/2014 | Roux | A61H 33/60 4/584 |
| 2017/0128322 | A1* | 5/2017 | Fassihi | A61P 3/02 |
| 2021/0093854 | A1* | 4/2021 | Pham | A61N 1/303 |
| 2021/0346235 | A1* | 11/2021 | Devanaboyina | A61H 9/0078 |
| 2024/0374466 | A1* | 11/2024 | Howe | A61H 9/0021 |

* cited by examiner

DEVICE FOR REHABILITATION OF APPENDAGES AND JOINTS HAVING MULTIPLE DEGREES OF FREEDOM

BACKGROUND OF THE INVENTION

1. Field of the Invention

The present invention relates to devices for rehabilitating injured or weakened human body parts. More particularly, the present invention is directed to devices for rehabilitating injured or weakened complex appendages having multiple degrees of freedom.

2. Background

Injuries, surgeries, or illnesses are known to cause loss of mobility, muscular weakness, and tightening or shortening of the muscles, tendons, or other tissues (commonly known as "contractures") in human appendages. Typically, physical therapy is required to treat loss of mobility, weakness, and contractures and, for most joints, a physical therapist will generally use manipulation, heat/cold therapy, and exercise for the rehabilitation regimen. In this regard, it is common to use mechanical exercise devices for rehabilitation and strengthening of the injured appendage. However, there are few devices which can be used to strengthen and rehabilitate complex appendages having multiple degrees of freedom such as the wrists/hand and ankles/feet.

As an example, wrist joints can be flexed/extended forward and backward, pivoted side-to-side, and rotated. For a mechanical device to exercise each of these different mobilities, the rehabilitation device would need to be exceedingly complex. Consequently, for injuries to the wrists/hands, physical therapists have traditionally incorporated exercise methods which don't rely on mechanical devices. For example, a hot wax bath can be provided which the patient immerses their wrists/hands into and exercise their wrists/hands therein. The use of hot wax, however, requires removal of the wax from the patient's hands after the exercise and, further, provides only limited resistance which cannot not be controllably increased or decreased.

To provide for greater resistance, it is known that a device can be attached to the hands/feet and includes a movement resisting plate/fin that displaces the hot wax/liquid as the wrist/ankle joint is moved/flexed. See Ostergard, U.S. Pat. No. 4,767,118. It is also known that a magnetorheological (MR) fluid can be used in place of hot wax whereby the resistance provided by the MR fluid can be controllably increased or decreased by applying a magnetic field through MR fluid. See Carlson et al., U.S. Pat. No. 5,693,004.

However, these devices can be cumbersome and unwieldly to use and can be costly and complicated to implement. Accordingly, there exists a need for an improved device for rehabilitating complex appendages and joints having multiple degrees of freedom.

SUMMARY OF THE INVENTION

In the present invention, a rehabilitation device for exercising a human appendage comprises a housing having a fluid reservoir with an opening wherethrough a human appendage is inserted into the reservoir, a thermally controllable viscous fluid contained within the reservoir, a heating apparatus for increasing the temperature of the fluid, and a cooling apparatus for decreasing the temperature of the fluid. The fluid has a temperature and a viscosity and experiences an apparent change in viscosity when exposed to a change in temperature. The heating apparatus and the cooling apparatus are controllable for selectively increasing or decreasing the temperature of the fluid and, correspondingly, decreasing or increasing the viscosity of the fluid.

Preferably, the rehabilitation device further comprises a deformable fluid impermeable material surrounding the appendage which prevents direct contact between the appendage and the thermally controllable viscous fluid. Yet more preferably, an elastic membrane is provided extending over and sealing the opening, wherein the elastic membrane deforms and conforms to the appendage during use.

Preferably, the rehabilitation device further comprises a control device that is operatively connected to the heating apparatus and the cooling apparatus for selectively increasing or decreasing the temperature of the fluid.

Yet more preferably, the rehabilitation device further comprises a cooling switch and a heating switch. The cooling switch is operatively connected to the cooling apparatus for selectively decreasing the temperature of the fluid, and the heating switch is operatively connected to the heating apparatus for selectively increasing the temperature of the fluid.

Preferably, the housing includes a thermally insulating layer for maintaining the temperature of the thermally controllable viscous fluid.

Preferably, the reservoir comprises an interior surface and the cooling apparatus comprises an evaporator, wherein the evaporator is a helically coiled tube mounted within the reservoir and lining the reservoir interior surface.

Preferably, the reservoir comprises a bottom surface and the heating apparatus comprises a heating element mounted within the reservoir adjacent the bottom surface. Yet more preferably, a barrier is formed within the reservoir preventing the appendage from contacting the heating element.

Preferably, the heating coil is encased in a coating. Yet more preferably, the coating is a thermally-conductive, electrically-insulative epoxy.

Preferably, the thermally controllable viscous fluid is selected from the group consisting of high fructose corn syrup, honey, and glycerin.

In another embodiment of the present invention, a rehabilitation device for exercising a human appendage comprises a fluid reservoir having an opening wherethrough a human appendage is inserted into the reservoir; a thermally controllable viscous fluid contained within the reservoir, the thermally controllable viscous fluid having a temperature and a viscosity; and, a temperature control apparatus for selectively increasing or decreasing the temperature of the thermally controllable viscous fluid. The thermally controllable viscous fluid experiences an apparent change in viscosity when exposed to a change in temperature and the temperature control apparatus is controllable via a reversing valve for selectively increasing or decreasing the temperature, and thereby decreasing or increasing the viscosity, of the thermally controllable viscous fluid.

Preferably, the temperature control apparatus comprises a compressor which compresses a refrigerant, an exterior coil disposed outside of the reservoir, and an interior coil disposed within the reservoir. The compressor, the exterior coil, and the interior coil are each in fluid communication with the reversing valve, and the exterior coil and the interior coil are in fluid connect with each other. The reversing valve can be selectively toggled between a cooling position and a heating position. When the reversing valve is in the cooling position, compressed refrigerant is conveyed from the compressor first through the exterior coil and then through the interior coil for absorbing heat from the thermally controllable viscous fluid and thereby reducing the temperature thereof. When the control valve is in the heating position, compressed refrigerant is conveyed from the compressor first through the interior coil for transferring heat from the refrigerant to the thermally controllable viscous fluid and thereby increase the temperature thereof.

In yet another embodiment of the present invention, a method of exercising a human appendage comprises the step of: immersing the appendage within a thermally controllable viscous fluid having a temperature and a viscosity, wherein the thermally controllable viscous fluid experiences an apparent change in viscosity when exposed to a change in temperature; selectively increasing and/or decreasing the temperature of the fluid and thereby decreasing and/or increasing its viscosity; and, moving the appendage through the thermally controllable viscous fluid, whereby the thermally controllable viscous fluid provides resistance forces relative to the viscosity thereof for exercising the appendage.

Preferably, the method further comprises the step of providing a fluid reservoir wherein the thermally controllable viscous fluid is contained and which includes an opening wherethrough the human appendage is inserted and thereby immersed within the thermally controllable viscous fluid.

Preferably, the method of claim further comprises the step of providing an elastic membrane extending over the reservoir opening and wherein, during the steps of immersing and moving, also deforming the elastic membrane whereby the elastic membrane conforms to the appendage and prevents direct contact between the appendage and the thermally controllable viscous fluid.

Preferably, prior to the step of immersing, the method further comprises the step of inserting the appendage into or wrapping the appendage with a deformable fluid impermeable material and, during the steps of immersing and moving, preventing direct contact between the appendage and the thermally controllable viscous fluid. Yet more preferably, the deformable fluid impermeable material is in the form of a plastic bag, glove, sock, or cellophane.

BRIEF DESCRIPTION OF THE DRAWINGS

The above-mentioned and other features of this invention and the manner of attaining them will become more apparent, and the invention itself will be better understood by reference to the following description of the embodiments of the invention, taken in conjunction with the accompanying drawings, wherein.

Figure 1:
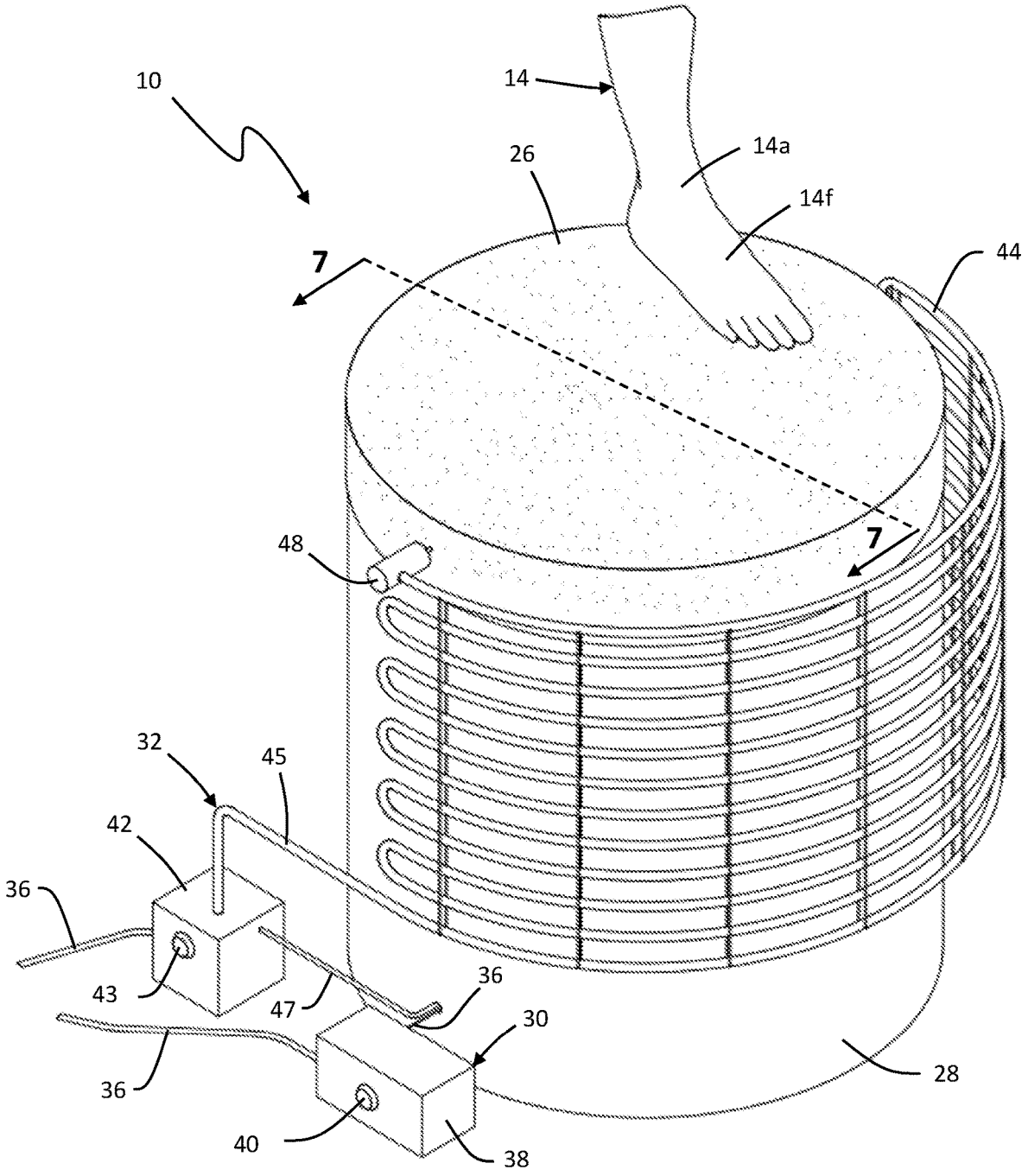
FIG. 1 is a perspective view of an appendage rehabilitation device constructed in accordance with the principles of the present invention.

Corresponding reference characters indicate corresponding parts throughout several views. Although the exemplification set out herein illustrates certain embodiments of the invention, the embodiments disclosed below are not intended to be exhaustive or to be construed as limiting the scope of the invention to the precise form disclosed.

DETAILED DESCRIPTION OF THE PREFERRED EMBODIMENTS

An appendage rehabilitation device constructed in accordance with the principles of the present invention is shown and designated by the numeral 10. The rehabilitation device 10 is adapted for rehabilitating and strengthening the muscles of an appendage 14 and, in particular, for rehabilitating and strengthening the muscles of complex, multiple-degree-of-freedom appendages, such as, for example, the ankles/feet and the wrists/hands. For a variety of reasons, such as, for example, injuries, surgeries, or illnesses, patients can experience loss of mobility, muscular weakness, and tightening or shortening of the muscles, tendons, or other tissues (commonly known as "contractures") in their appendages 14. The rehabilitation device 10 can be used to treat such contractures and issues and for rehabilitating and strengthening the muscles of the injured appendage 14.

Complex appendages 14, such as the ankles/feet and the wrists/hands, for example, can be flexed/extended forward and backward, pivoted side-to-side, and rotated back and forth. In order to fully rehabilitate the appendage 14, the rehabilitation device 10 includes a volume of thermally controllable viscous fluid 12 wherein the device 10 is used by immersing the appendage 14 in the viscous fluid 12 and then moving/flexing/rotating the appendage 14 through its range of motion. As the appendage 14 is moved/flexed/rotated, the viscous fluid 12 is displaced and internal friction within the viscous fluid 12 provides movement opposing resistance forces for thereby exercising and strengthening the muscles of the appendage 14. Viscosity is a measure of the internal friction which resists flow/displacement of a fluid, and thus, the viscosity of the viscous fluid 12 directly relates to the level of resistance provided by the rehabilitation device 10.

To allow a user to selectively control the resistance provided by the rehabilitation device 10, the thermally controllable viscous fluid 12 is configured to increase in viscosity as its temperature decreases and decrease in viscosity as its temperature increases. For example, by selectively increasing the temperature of the viscous fluid 12, the viscosity of the fluid 12, and thus, the level of resistance, will correspondingly decrease. Alternatively, by selectively decreasing the temperature of the viscous fluid 12, the viscosity of the fluid 12, and thus, the level of resistance, will correspondingly increase.

Preferably, the viscous fluid 12 has a relatively wide viscosity range (e.g., the viscous fluid 12 can become very thick/viscous or very thin/water-like) such that the rehabilitation device 10 can provide a wide range of resistance levels. Yet more preferably, the viscous fluid 12 has a relatively wide viscosity range within a temperature range that overlaps with room temperature such that the rehabilitation device 10 can provide a wide range of resistance levels within a temperature range that is safe for the patients. For example, the viscous fluid 12 can be high fructose corn syrup (HFCS), honey, glycerin, or other similarly viscous fluids. Preferably, the thermally controllable viscous fluid 12 comprises HFCS as it is inexpensive and is known to resist the growth of bacteria. Preferably, an anti-fungal and/or anti-bacterial compound, such as, for example, silver ions, amphotericin, fluconazole, or other anti-fungal/anti-bacterial compounds, can be added to the viscous fluid 12 for preventing the growth of fungi or bacteria therein.

Figure 2:
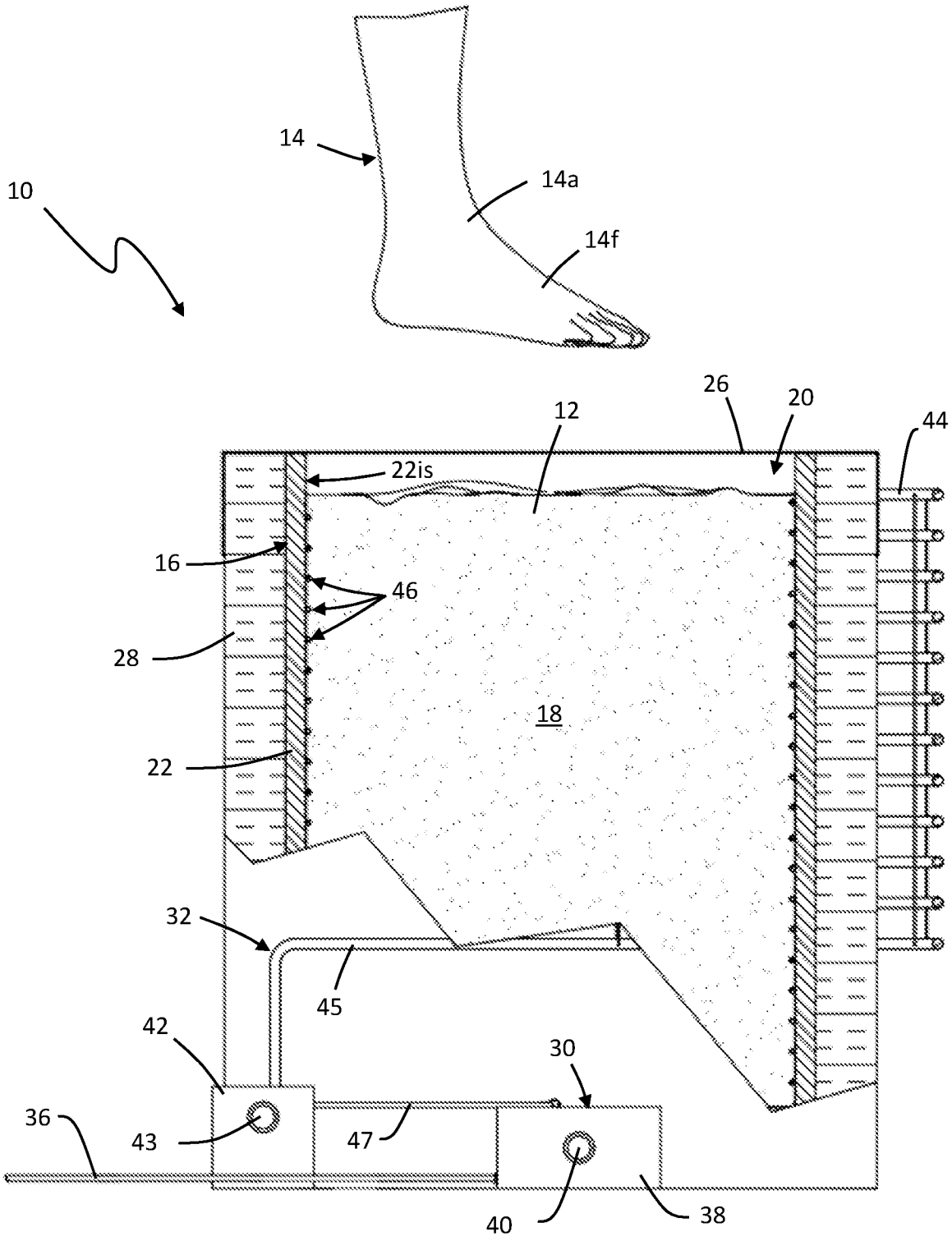
FIG. 2 is a side elevation view of the rehabilitation device with a portion removed to show the interior of the rehabilitation device.

As shown in FIGS. 1 and 2, the appendage rehabilitation device 10 comprises a drum-like housing 16 having a fluid reservoir 18 formed therein and an opening 20 leading to the reservoir 18. The housing 16 includes a tube-shaped cylindrical wall 22 having a cylindrical interior surface 22*is* and a base 24 having a top surface 24*ts*. The cylindrical wall 22 extends upwardly from the base 24 top surface 24*ts*. Together the cylindrical interior surface 22*is* and the top surface 24*ts* define the fluid reservoir 18. The opening 20 is formed at the upper end of the cylindrical wall 22 opposite the base 24 and is adapted to receive an appendage 14 therethrough. The fluid reservoir 18 is sized for allowing an appendage 14 to freely move/flex/extend/rotate within the fluid reservoir 18 and for containing a sufficient volume of viscous liquid 12 for immersion of the appendage 14 therein.

Preferably, the housing 16 is integrally formed by casting, molding, machining, or otherwise forming the cylindrical wall 22 and the base 24 from a unitary material such as, for example, steel, aluminum, plastic materials, ceramic materials, or cementitious materials. Yet more preferably, the cylindrical wall 22 and the base 24 are integrally formed from a thermally insulative ceramic material.

As best seen in FIGS. 1, 7, and 9-12, the rehabilitation device 10 can include a deformable fluid impermeable material 26 which surrounds the appendage 14 and forms a fluid barrier between the appendage 14 and the viscous fluid 12. Preferably, the deformable fluid impermeable material 26 simultaneously prevents contamination of the viscous fluid 12 and eliminates the need to clean/wash the viscous fluid 12 off the appendage 14 following use of the rehabilitation device 10.

Preferably, the fluid impermeable material 26 can be an elastic membrane 26*a* (FIG. 7) which covers/seals the opening 20. In operation, as an appendage 14 is extended through the opening 20, the elastic membrane 26*a* stretches/deforms and surrounds/conforms to the appendage 14. The fluid impermeable material 26 can also be, for example, a glove 26*b* (FIG. 9), a sock 26*c* (FIG. 10), or a plastic film bag 26*d* (FIG. 11) which the appendage 14 can be inserted into. Preferably, the deformable fluid impermeable material 26 is formed from materials such as, for example, latex, silicon, nitrile, vinyl, or other sufficiently elastic, fluid impermeable materials.

The fluid impermeable material 26 can also be, for example, a cellophane or other film-like material 26*e* (FIG. 12) which can be wrapped around and which covers the appendage 14. Preferably, an adhesive can be used for securing and sealing the cellophane material 26*d* to itself for thereby forming a fluid impermeable barrier surrounding the appendage 14.

As shown in FIGS. 1 and 2, the rehabilitation device 10 can also include a thermal insulation layer 28, a heating apparatus 30, and a cooling apparatus 32. The thermal insulation layer 28 is adapted to substantially thermally isolate the rehabilitation device 10 for maintaining the temperature of the viscous fluid 12 and can be, for example, a thermally insulating foam, rubber, or fiber-based material which is secured to and surrounds the housing 16. The heating and cooling apparatuses 30, 32 operably engage the viscous fluid 12 and are adapted to selectively increase or decrease the temperature thereof. As mentioned above, the viscous fluid 12 is thermally controllable whereby increasing or decreasing the temperature of the fluid 12 correspondingly decreases or increases the viscosity of the fluid 12. Accordingly, the heating and cooling apparatuses 30, 32 can be used for selectively increasing or decreasing the viscosity of the fluid 12.

Figure 3:
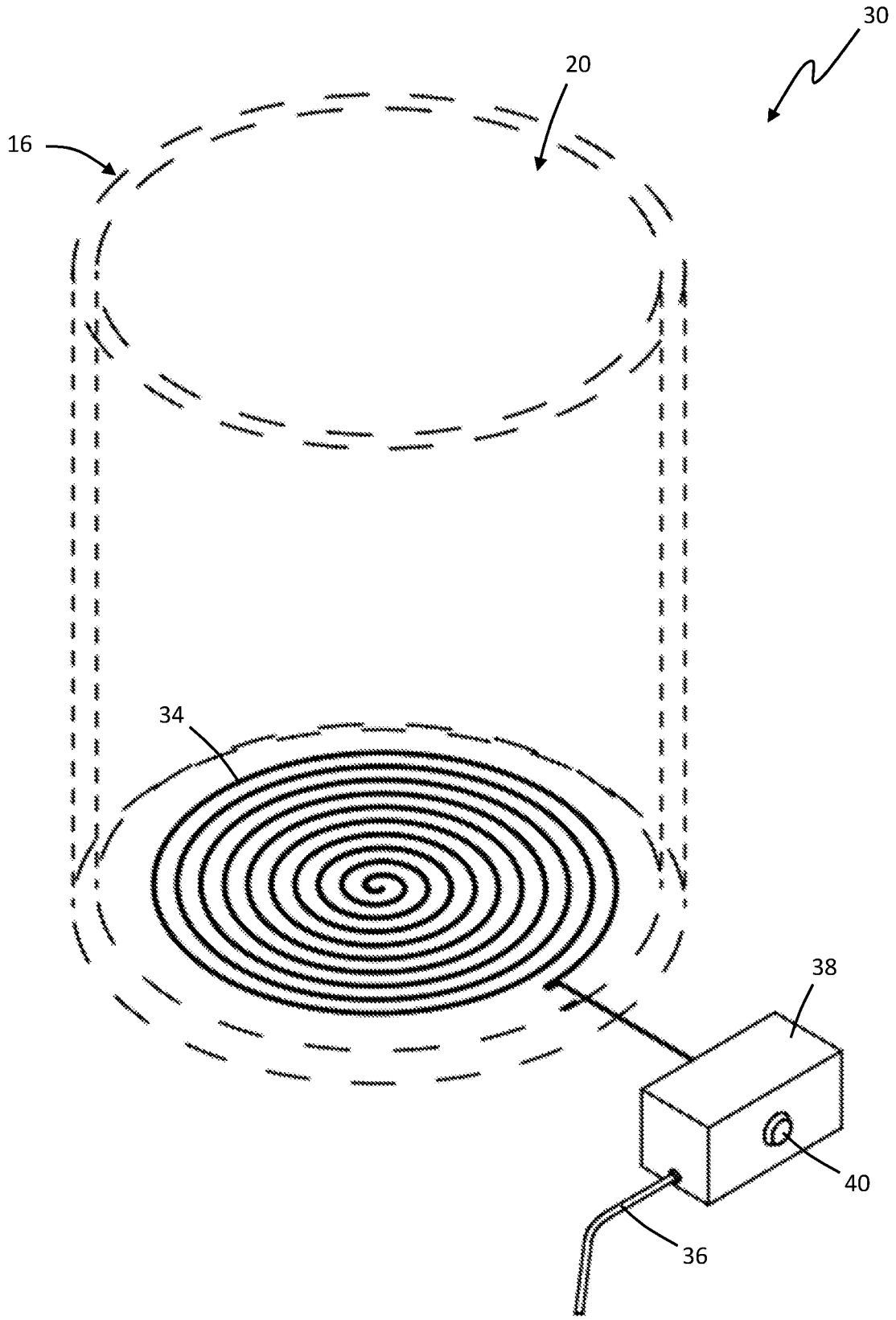
FIG. 3 is a perspective view of the heating apparatus shown in FIG. 1.
Figure 4:
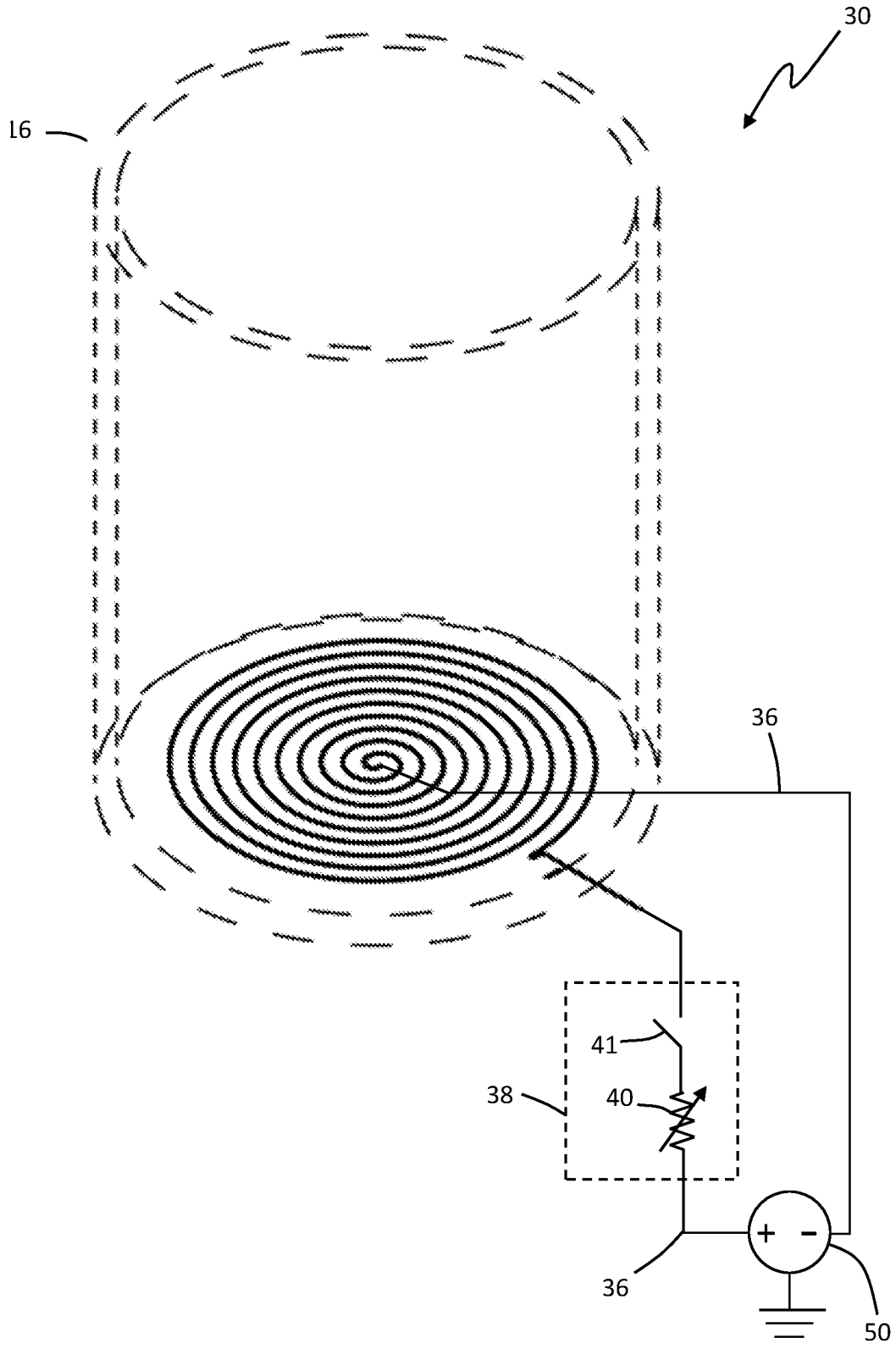
FIG. 4 is a diagrammatic perspective view of the heating apparatus.

As shown in FIGS. 3 and 4, the heating apparatus 30 can comprise a heating element 34, electrical cables 36, and a heater control unit 38. The heating element 34 can be, for example, an AC or DC resistive-type heating element disposed within the reservoir 18 or embedded in the housing 16 and adapted to heat the viscous fluid 12. The heater control unit 38 is operatively connected to the heating element 34 and is connected by the electrical cables 36 to an AC or DC power source 50. The heater control unit 38 allows an operator to selectively adjust the temperature of the heating element 34 for thereby modulating the temperature of the viscous fluid 12. Preferably, the heater control unit 38 can include an on-off switch 41 and a power regulator 40 for selectively adjusting the temperature of the heating element 34. The power regulator 40 can be, for example, a potentiometer, a rheostat, or another, similar component used for modulating the transmission of electricity through an electrical circuit.

Preferably, the heating element 34 is configured and sufficiently sized to heat the volume of viscous fluid 12 to a desired temperature within an acceptable timespan. Yet more preferably, the heating element 34 can be a planar DC resistance-type heating coil which is sized to fit within the reservoir 18 and covers the base 24 top surface 24*ts*, or which is embedded in the base 24. When heating element 34 is atop the base 24, it can be encased in a layer of thermally conductive but electrically resistive epoxy which is adapted to transmit heat from the heating apparatus 30 to the viscous fluid 12 while simultaneously electrically insulating viscous fluid 12 from the heating apparatus 30.

Figure 5:
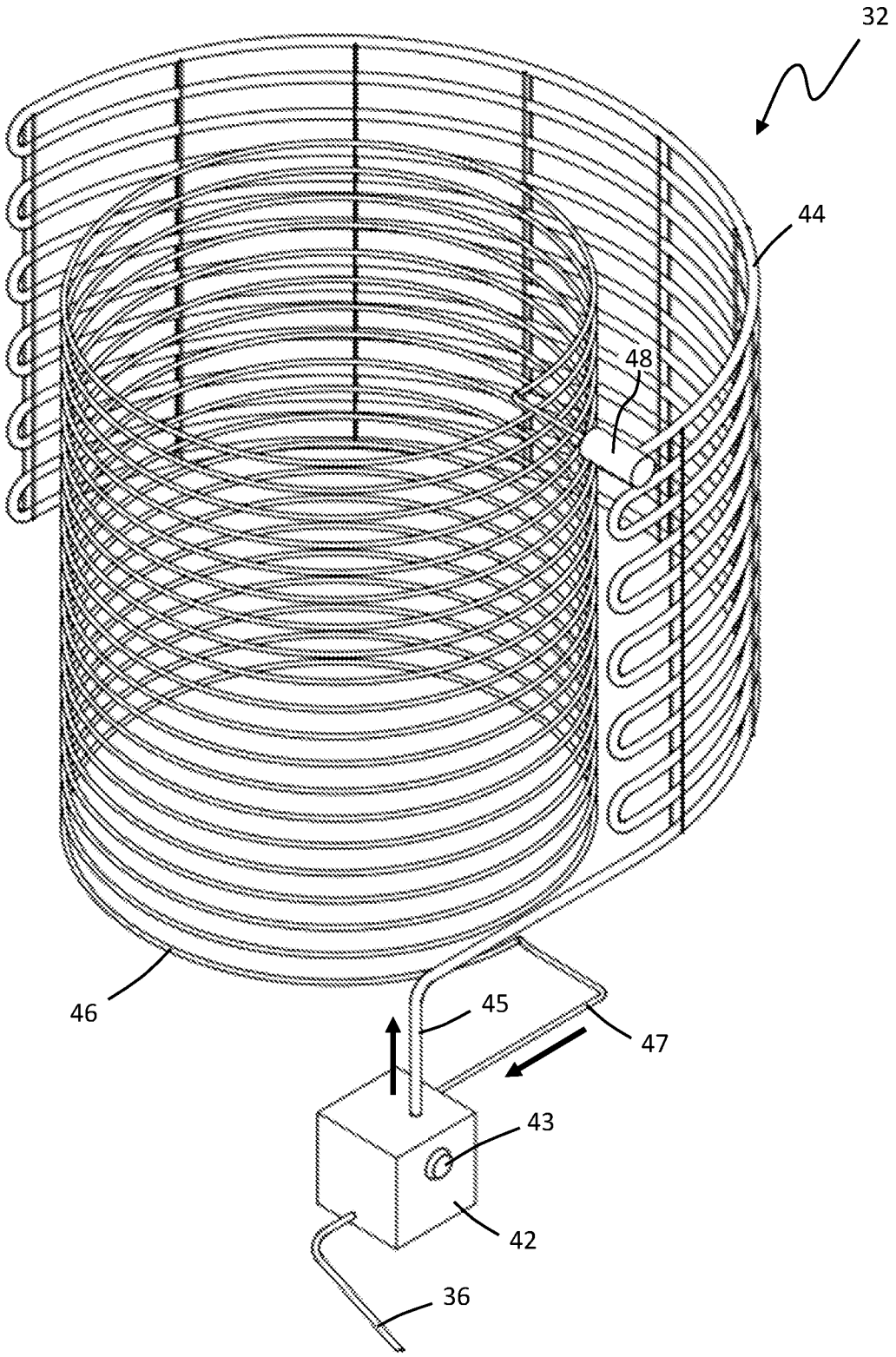
FIG. 5 is a perspective view of the cooling apparatus shown in FIG. 1.
Figure 6:
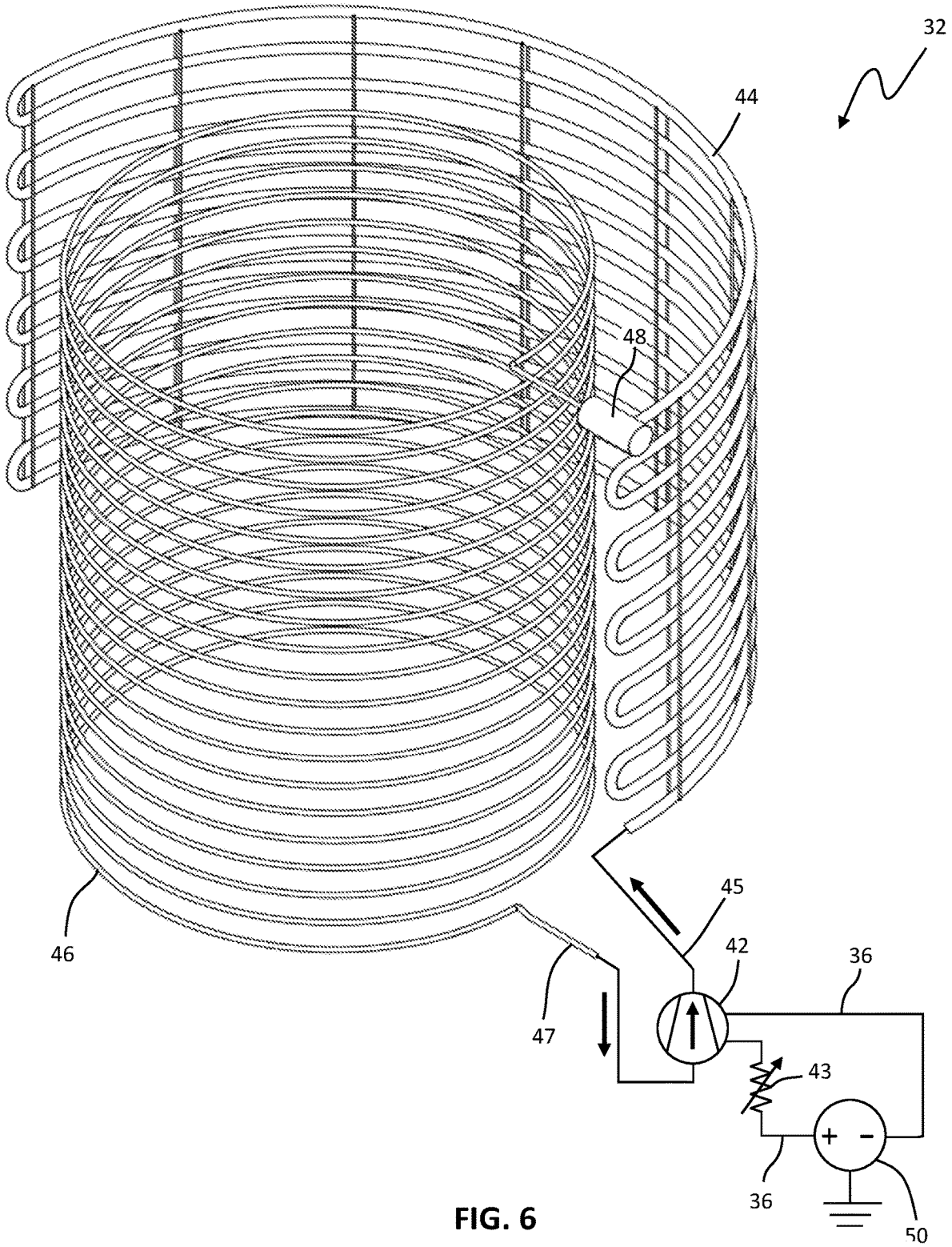
FIG. 6 is a diagrammatic perspective view of the cooling apparatus.
Figure 7:
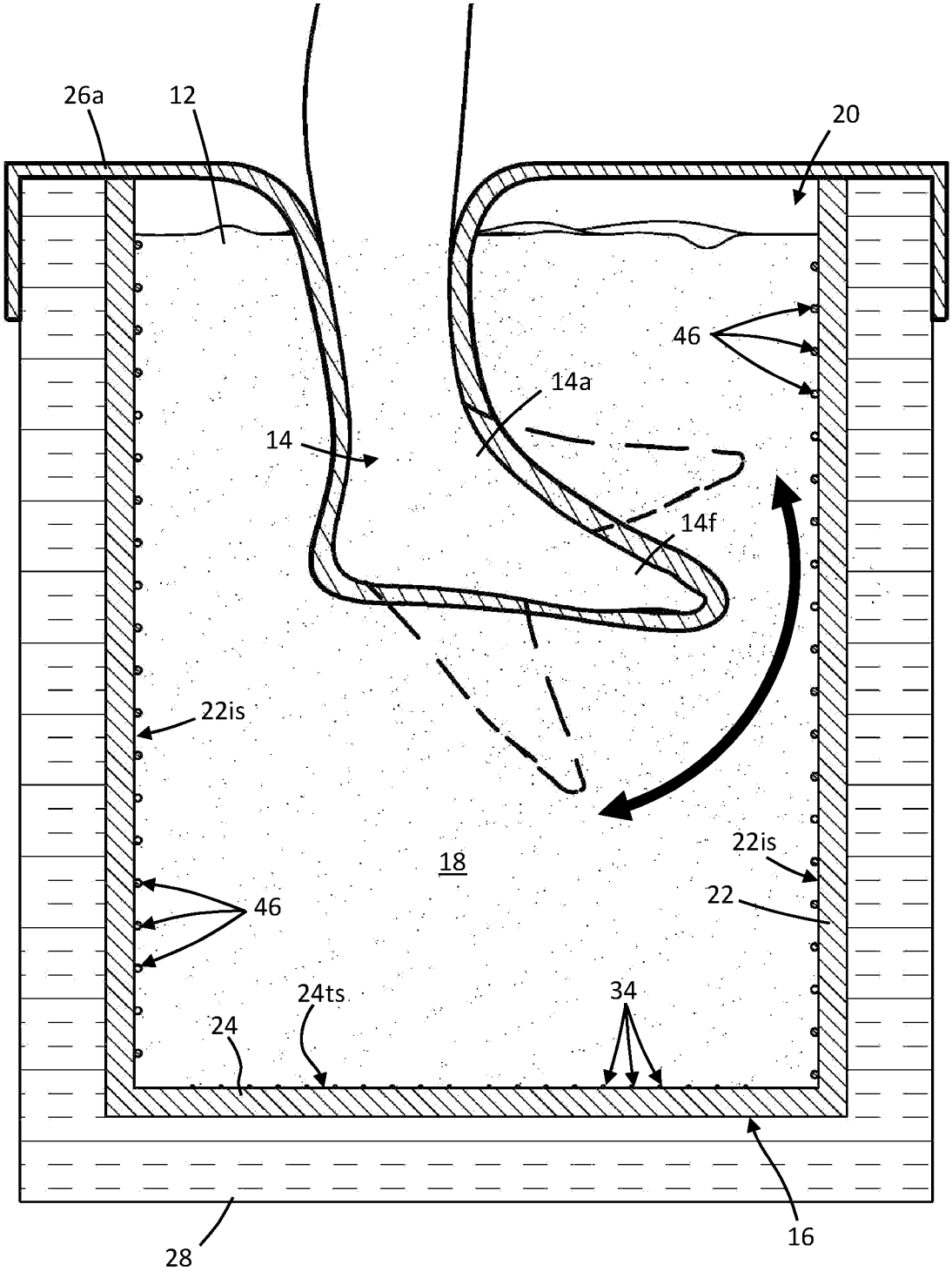
FIG. 7 is a cross section view taken along the line 5-5 shown in FIG. 1.

As shown in FIGS. 5 and 6, the cooling apparatus 32 can comprise a compressor 42, a condenser 44, and an evaporator 46. The compressor 42 can be disposed outside of the housing 16 and is connected to the power source 50 by electrical cables 36. The condenser 44 is operatively connected to the compressor 42 and can be mounted outside of the housing 16 or separately at a distance therefrom. The evaporator 46 is mounted within the reservoir 18 and is operatively connected to the condenser 44 and to the compressor 42. As best seen in FIG. 7, the evaporator 46 is immersed within the viscous fluid 12 and extracts heat therefrom. The evaporator 46 and the condenser 44 are, preferably, made of highly thermally conductive materials such as copper or aluminum tubing.

The compressor 42 can be, for example, a piston, rotary, screw, scroll, or centrifugal-type compressor, and the condenser 44 can be, for example, an air-cooled, water-cooled, or combined air and water cooled-type condenser. Preferably, the compressor 42 is sufficiently sized for powering the cooling apparatus 32 such that the volume of viscous fluid 12 can be cooled to a desired temperature within an acceptable timespan. The evaporator 46 is, preferably, a bare tube-type evaporator forming a helical coil (FIGS. 5 and 6) or a finned tube-type evaporator (not shown). Yet more preferably, the evaporator 46 is a bare tube-type evaporator forming a helical coil which is sized to fit within the reservoir 18 and lines the cylindrical wall 22 interior surface 22*is* or is embedded in the wall 22.

As is known to those skilled in the art and illustrated in FIG. 6, compressor 42 compresses a refrigerant (not shown) under high pressure and pumps the refrigerant into the condenser 44. As the refrigerant is compressed, it heats up, and, as the compressed, heated refrigerant travels through the condenser 44, heat is transferred from the refrigerant to the ambient air surrounding the condenser 44, causing the refrigerant to cool and condense into a liquid. Thereafter, the cooled, refrigerant travels through the evaporator 46, absorbing heat from the viscous fluid 12 and evaporating. The evaporated refrigerant then travels back to the compressor 42 and the cycle begins anew.

As shown in FIG. 4, the cooling apparatus 32 preferably also includes an expansion valve 48 which can be connected between the condenser 44 and the evaporator 46. The expansion valve 48 can be configured to reduce the pressure and reduce the temperature of the refrigerant in a known and customary manner as it enters the evaporator 46. Preferably, the cooling apparatus 32 is a closed-loop system whereby the refrigerant is substantially contained within the components of the cooling apparatus 32.

Preferably, the speed of the compressor 42 can be selectively controlled for thereby modulating the temperature of the viscous fluid 12. As shown diagrammatically in FIGS. 5 and 6, the compressor 42 can include a compressor control module 43 for selectively adjusting the speed/power of the compressor 42 and, hence, the level of cooling provided by the cooling apparatus 32. The compressor control module 43 can be, for example, a potentiometer, a rheostat, or another, similar component used for modulating the transmission of electricity through an electrical circuit.

Preferably, the heating and cooling apparatuses 30, 32 are appropriately sized and configured for selectively modulating the temperature of the viscous fluid 12 within a temperature range of between approximately fifty (50) and one-hundred five (105) degrees Fahrenheit. Yet more preferably, the cooling apparatus 32 can be configured for cooling the viscous fluid 12 to between approximately fifty (50) and sixty (60) degrees Fahrenheit for providing a cold bath-like treatment, and the heating apparatus 30 can be configured for heating the viscous fluid 12 to between approximately ninety (90) and one-hundred five (105) degrees Fahrenheit for providing a hot bath-like treatment.

Figure 8:
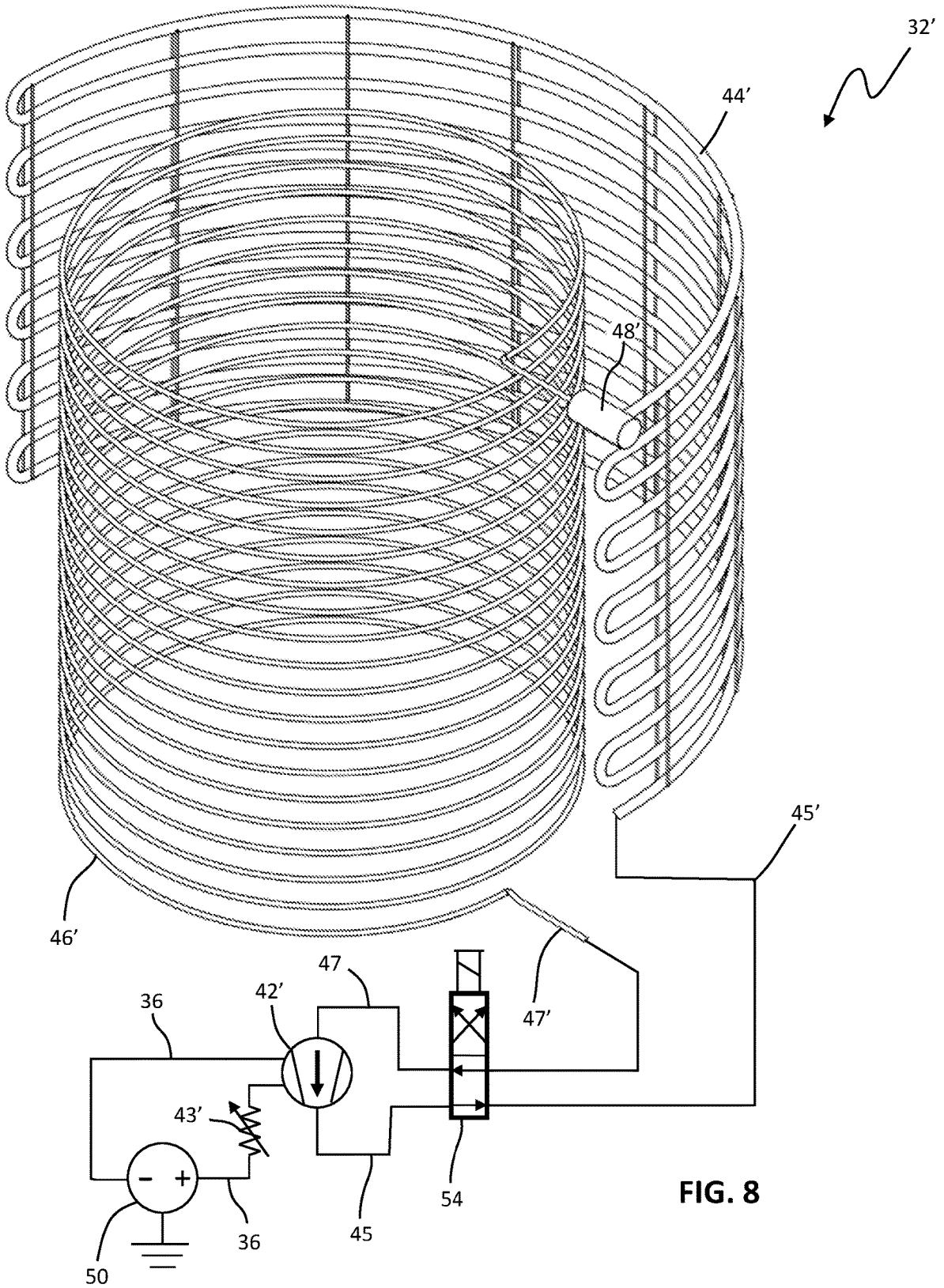
FIG. 8 is a diagrammatic perspective view of a heat pump type temperature control apparatus.
Figure 9:
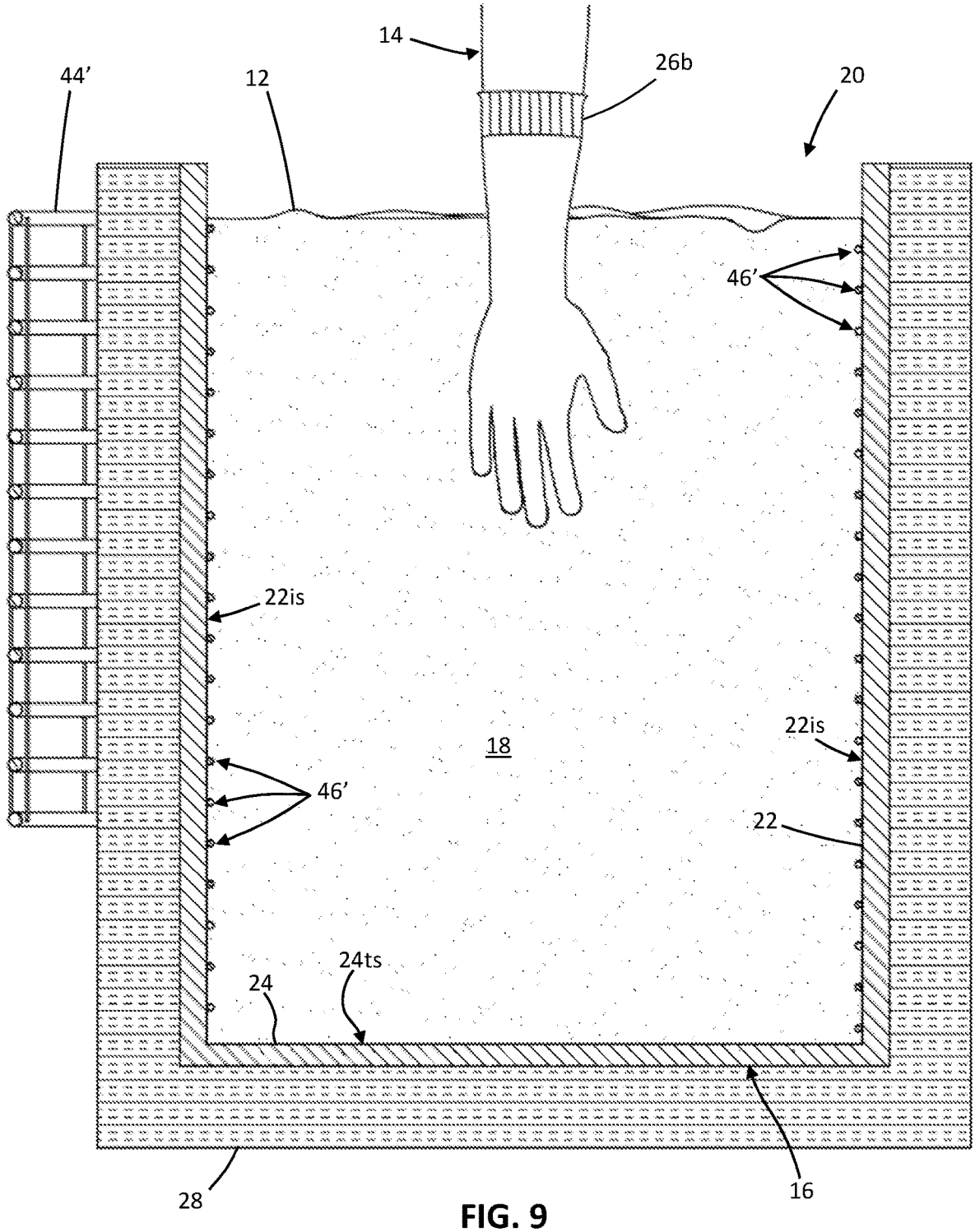
FIG. 9 is a cross section view taken along the line 7-7 shown in FIG. 1 showing a hand covered by a glove and submerged in the viscous fluid.
Figure 10:
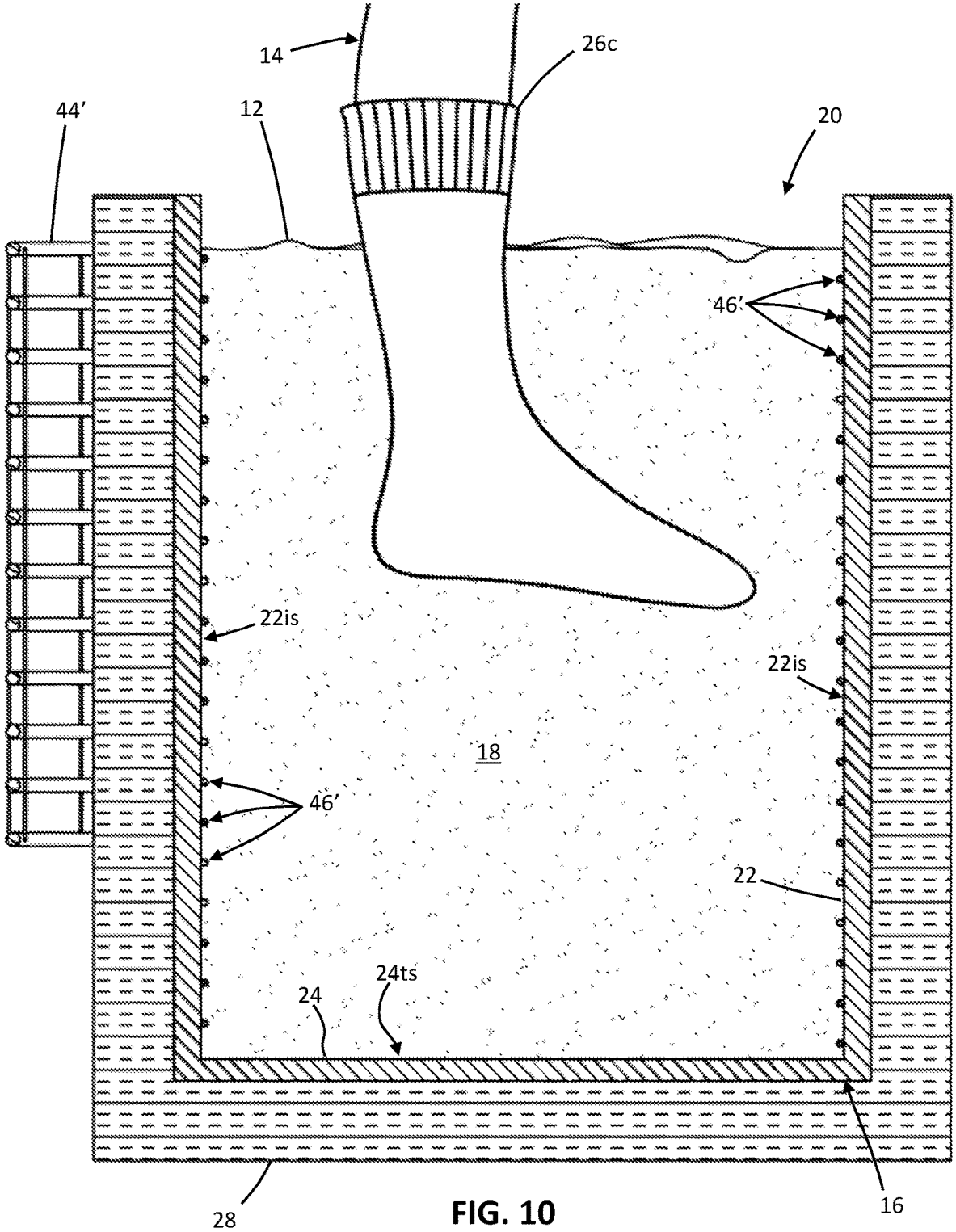
FIG. 10 is a cross section view taken along the line 7-7 shown in FIG. 1 showing a foot covered by a sock and submerged in the viscous fluid.
Figure 11:
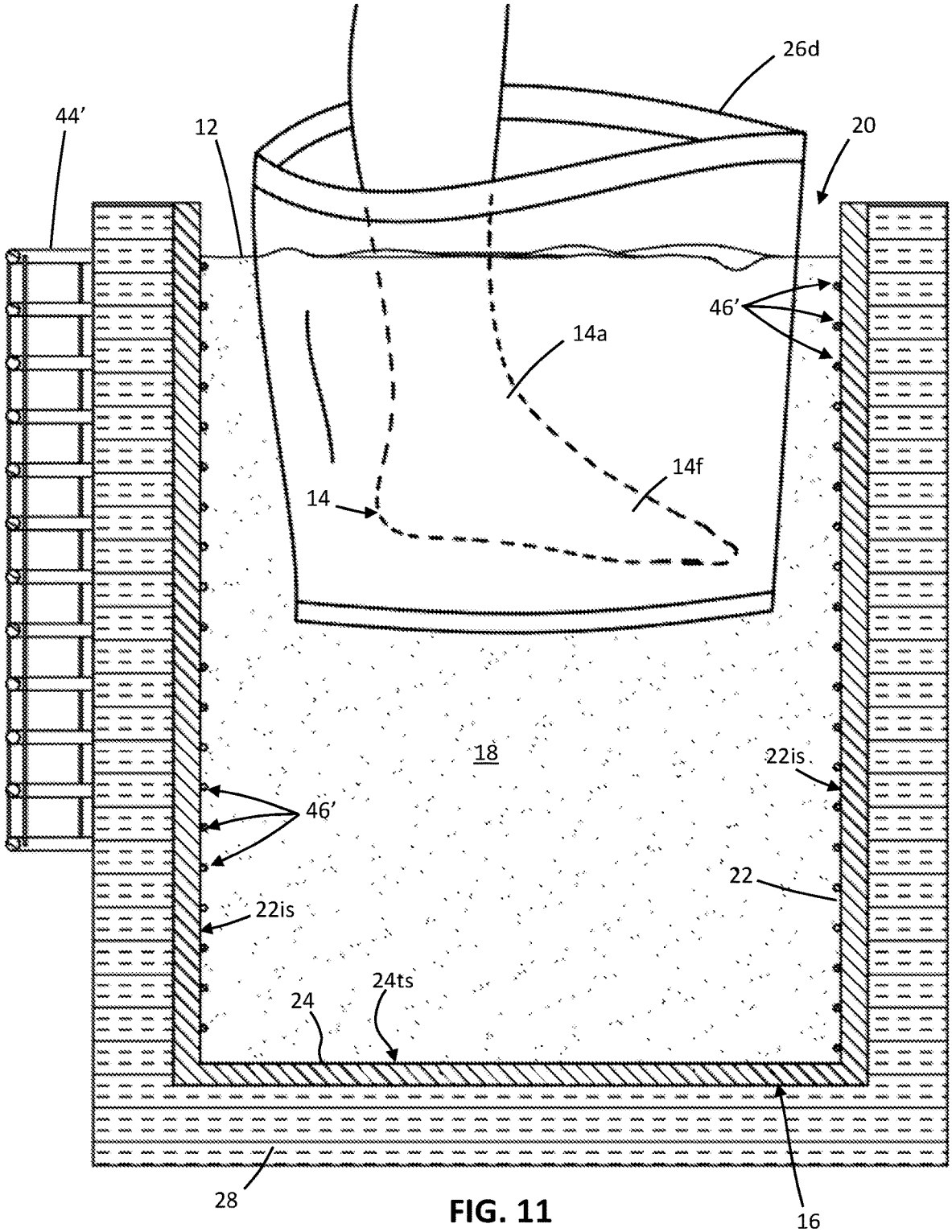
FIG. 11 is a cross section view taken along the line 7-7 shown in FIG. 1 showing the foot inserted into a plastic film bag and submerged in the viscous fluid; and, FIG. 12 is a cross section view taken along the line 7-7 shown in FIG. 1 showing the foot wrapped with a film-like material and submerged in the viscous fluid.
Figure 12:
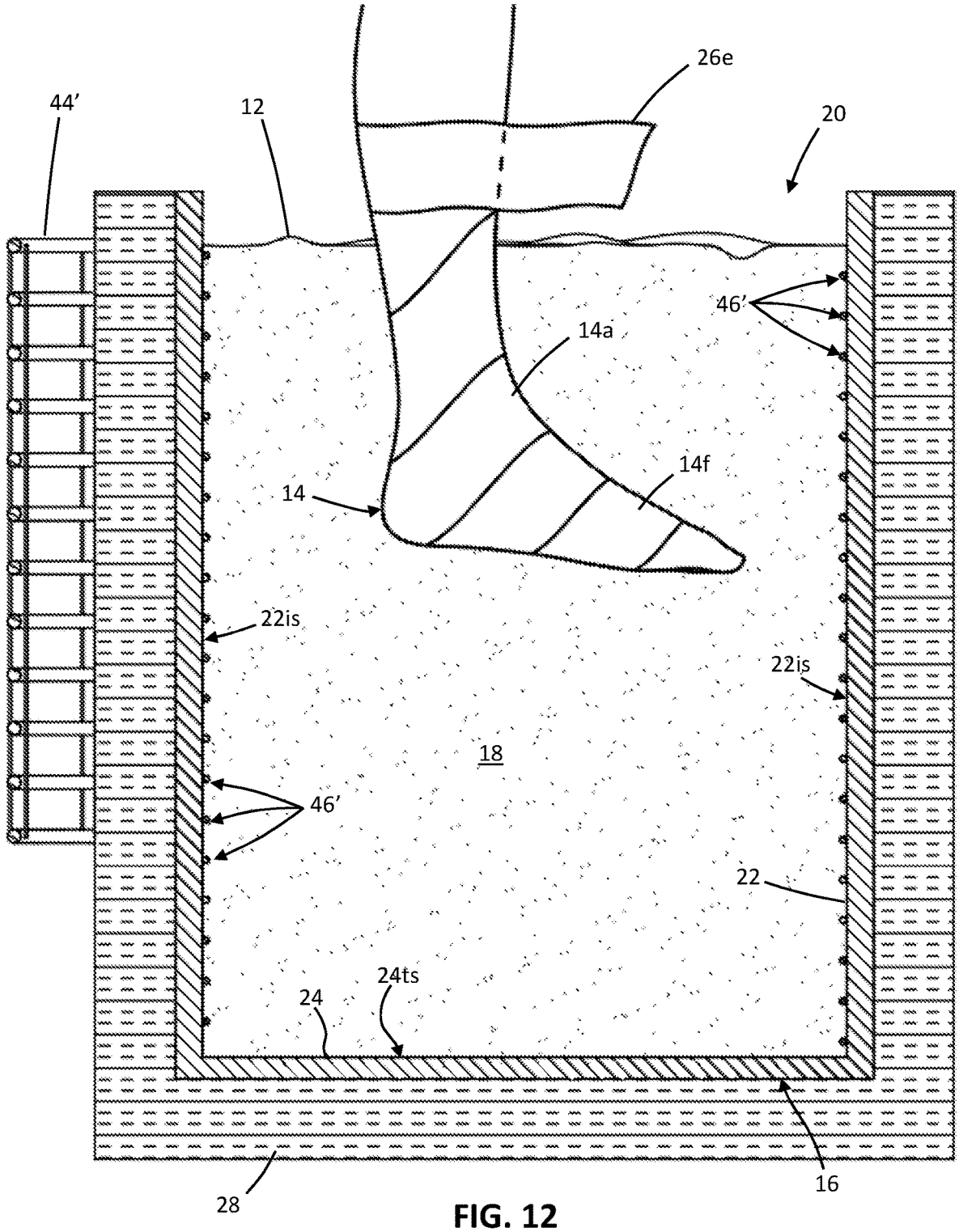

In another embodiment, as diagrammatically shown in FIG. 8, the rehabilitation device 10 can include a heat pump type temperature control apparatus 32' comprising a compressor 42', an exterior coil 44', an interior coil 46', and a reversing valve 54. The compressor 42' and the exterior coil 44' can be disposed outside of the housing 16 or separately at a distance therefrom and the interior coil 46' can be mounted within the reservoir 18 in contact with the viscous fluid 12. The exterior and interior coils 44', 46' are connected to each other and to the reversing valve 54. The compressor 42' is electrically connected to the power source 50 and can be selectively controlled via a compressor control module 43'. The compressor 42' further includes an output conduit 45 and an input conduit 47 which are connected to the reversing valve 54. Compressed, heated refrigerant is pumped out of the compressor 42' through the output conduit 45, and evaporated refrigerant is returned to the compressor 42' through the input conduit 47.

In a first cooling position as shown in FIG. 8, the reversing valve 54 directs compressed, heated refrigerant from the output conduit 45, through conduit 45' to the exterior coil 44', which acts like a condenser. The refrigerant then passes through the interior coil 46', which acts like an evaporator and absorbs heat from the viscous fluid 12 before conveying the refrigerant back to the compressor 42' through the input conduits 47' and 47. In a second heating position (when conduit 45 is connected to conduit 47' and conduit 47 is connected to conduit 45'), the reversing valve 54 directs compressed, heated refrigerant from the output conduit 45, through conduit 47' to the interior coil 46' which now acts like a condenser whereby heat is transferred from the compressed heated refrigerant to the viscous fluid 12 for increasing the temperature thereof. The refrigerant then passes through the exterior coil 44' where it absorbs heat from the ambient air and is conveyed back to the compressor 42' through conduits 45' and 47.

As should now be appreciated, when the reversing valve 54 is in the cooling position, the heat pump type temperature control apparatus 32' acts like the cooling apparatus 32 for cooling the viscous fluid 12, and, when the reversing valve 54 is in the heating position, the heat pump type temperature control apparatus 32' acts like a heater for heating the viscous fluid 12. Accordingly, the temperature control apparatus 32' can be configured to selectively heat or cool the viscous fluid 12, and thereby selectively increase or decrease the level of resistance provided by the rehabilitation device 10, without need for a separate heating apparatus 30. Preferably, the reversing valve 54 and the compressor control module 43' can be used to selectively control the heat pump type temperature control apparatus 32' and thereby heat or cool the viscous fluid 12 to the desired temperature.

Preferably, the temperature control apparatus 32' also includes an expansion valve 48' which can be connected between the exterior coil 44' and the interior coil 46'. The expansion valve 48' can be adapted to reduce the pressure of the refrigerant as it travels from the exterior coil 44' to the interior coil 46', or from the interior coil 46' to the exterior coil 44'.

Preferably, the exterior and interior coils 44', 46' are formed from thermally conductive materials such as, for example, copper or aluminum tubing, and are sufficiently sized for heating or cooling the viscous fluid 12 to a desired temperature. Yet more preferably, the interior coil 46' is a bare tube-type, helical coil heat exchanger formed from copper tubing and the exterior coil 44' is an air-cooled, bare tube-type heat exchanger formed from copper or aluminum tubing. The interior coil 46' is preferably sized to fit within the reservoir 18 and lines the cylindrical wall 22 interior surface 22*is* or is embedded within the wall 22, and the exterior coil 44' is preferably mounted to the exterior of the housing 16.

In operation, as mentioned above, the rehabilitation device 10 is adapted to provide resistance for rehabilitating and strengthening the muscles of a complex, multiple-degree-of-freedom appendage 14. The rehabilitation device 10 is used by lowering/extending a complex appendage 14, such as, for example, an ankle 14*a* and a foot 14*f*, through the opening 20 into the reservoir 18 until the appendage 14 is substantially immersed in the viscous fluid 12. As shown in FIG. 7, as the appendage 14 is lowered/extended through the opening 20, the elastic membrane 26*a* deforms, surrounding and conforming to the appendage for preventing direct contact with the viscous fluid 12.

The ankle 14*a* can then be moved/flexed/rotated, thereby moving the foot 14*f* through and displacing the fluid 12. As mentioned hereinabove, as the foot 14*f* moves through the viscous fluid 12, the viscosity of the fluid 12 resists the movement and provides opposing resistance forces for exercising and rehabilitating/strengthening the muscles of the ankle 14*a*. To increase or decrease the level of resistance, an operator can selectively modulate the heating and cooling of the fluid 12 of the apparatuses 30, 32 via the heater power regulator 40 and the compressor control module 43, or the temperature control apparatus 32' via the reversing valve 54 and the compressor control module 43', for thereby selectively modulating the temperature, and, hence, the viscosity, of the viscous fluid 12.

In traditional, mechanical exercise devices, resistance is provided in only a single degree of freedom and the muscles of the appendage 14 are strengthened in only a single range of motion. As should now be appreciated, with the rehabilitation device 10 of the present invention, the appendage 14 is immersed within the viscous fluid 12 and is free to move/flex/rotate in any direction, and the viscous fluid 12 correspondingly resists any such movement. Thus, the rehabilitation device 10 can be used for rehabilitating and strengthening each of the muscles of the appendage 14 throughout the full range of mobility thereof, regardless of the number of degrees of freedom.

While this invention has been described as having an exemplary embodiment, the present invention may be further modified within the spirit and scope of this disclosure. This application is therefore intended to cover any variations, uses, or adaptations of the invention using its general principles.

What is claimed is:

1. A rehabilitation device for exercising a human appendage, the rehabilitation device comprising:

a fluid reservoir having an opening wherethrough a human appendage can be inserted into the reservoir;

a thermally controllable viscous fluid contained within the reservoir, the thermally controllable viscous fluid having a temperature and a viscosity;

a heating apparatus for increasing the temperature of the thermally controllable viscous fluid; and, a cooling apparatus for decreasing the temperature of the thermally controllable viscous fluid;

wherein the thermally controllable viscous fluid experiences an apparent change in viscosity when exposed to a change in temperature; and, wherein the heating apparatus and the cooling apparatus are controllable for selectively increasing or decreasing the temperature, and thereby decreasing or increasing the viscosity, of the thermally controllable viscous fluid; and, further comprising an elastic membrane provided extending over the opening, wherein the elastic membrane is configured to deform and conform to the appendage when the appendage is inserted into the reservoir and prevent direct contact between the appendage and the thermally controllable viscous fluid, whereby a user can exercise the appendage by moving the appendage through the fluid.

2. The rehabilitation device of claim 1 further comprising a control device, wherein the control device is operatively connected to and controls the heating and cooling apparatuses for selectively increasing or decreasing the temperature of the thermally controllable viscous fluid.

3. The rehabilitation device of claim 1 further comprising a cooling control unit and a heating control unit, wherein the cooling control unit is operatively connected to the cooling apparatus and the heating control unit is operatively connected to the heating apparatus, and wherein the heating control unit and cooling control unit are used for selectively increasing or decreasing the temperature of the thermally controllable viscous fluid.

4. The rehabilitation device of claim 1 wherein the reservoir is within a housing which includes a thermally insulating layer for maintaining the temperature of the thermally controllable viscous fluid.

5. The rehabilitation device of claim 1 wherein the reservoir comprises an interior surface, wherein the cooling apparatus comprises an evaporator, and wherein the evaporator is located within the reservoir adjacent the reservoir interior surface.

6. The rehabilitation device of claim 1 wherein reservoir comprises a bottom surface, and where the heating apparatus comprises a heating element located adjacent the bottom surface.

7. The rehabilitation device of claim 6 wherein the heating element is encased in a coating of thermally-conductive, electrically-insulative epoxy.

8. The rehabilitation device of claim 1 wherein the thermally controllable viscous fluid is selected from the group consisting of high fructose corn syrup, honey and glycerin.

9. A rehabilitation device for exercising a human appendage, the rehabilitation device comprising:

a fluid reservoir having an opening wherethrough a human appendage can be inserted into the reservoir;

a thermally controllable viscous fluid contained within the reservoir, the thermally controllable viscous fluid having a temperature and a viscosity; and, a temperature control apparatus for selectively increasing or decreasing the temperature of the thermally controllable viscous fluid;

wherein the thermally controllable viscous fluid experiences an apparent change in viscosity when exposed to a change in temperature; and, wherein the temperature control apparatus is controllable via a reversing valve for selectively increasing or decreasing the temperature, and thereby decreasing or increasing the viscosity, of the thermally controllable viscous fluid; and, further comprising an elastic membrane provided extending over the opening, wherein the elastic membrane is configured to deform and conform to the appendage when the appendage is inserted into the reservoir and prevent direct contact between the appendage and the thermally controllable viscous fluid, whereby a user can exercise the appendage by moving the appendage through the fluid.

10. The rehabilitation device of claim 9, wherein the temperature control apparatus comprises:

a compressor which compresses a refrigerant;

an exterior coil disposed outside of the reservoir;

an interior coil disposed within the reservoir;

wherein the compressor, the exterior coil, and the interior coil are each in fluid communication with the reversing valve, and the exterior coil and the interior coil are in fluid connect with each other;

wherein the reversing valve can be selectively toggled between a cooling position and a heating position;

wherein, when the reversing valve is in the cooling position, compressed refrigerant is conveyed from the compressor first through the exterior coil and then through the interior coil for absorbing heat from the thermally controllable viscous fluid and thereby reducing the temperature thereof; and, wherein, when the control valve is in the heating position, compressed refrigerant is conveyed from the compressor first through the interior coil for transferring heat from the refrigerant to the thermally controllable viscous fluid and thereby increase the temperature thereof.

11. The rehabilitation device of claim 9 wherein the thermally controllable viscous fluid is selected from the group consisting of high fructose corn syrup, honey and glycerin.

12. A method of exercising a human appendage comprising the steps of:

immersing the appendage within a thermally controllable viscous fluid having a temperature and a viscosity, wherein the thermally controllable viscous fluid experiences an apparent change in viscosity when exposed to a change in temperature;

selectively increasing and/or decreasing the temperature of the fluid and thereby decreasing and/or increasing its viscosity; and, moving the appendage through the thermally controllable viscous fluid, whereby the thermally controllable viscous fluid provides resistance forces relative to the viscosity thereof for exercising the appendage;

wherein a fluid reservoir is provided wherein the thermally controllable viscous fluid is contained and which includes an opening wherethrough the human appendage is inserted and thereby immersed within the thermally controllable viscous fluid; and, wherein an elastic membrane is provided extending over the reservoir opening and wherein, during the steps of immersing and moving, also deforming the elastic membrane whereby the elastic membrane conforms to the appendage and prevents direct contact between the appendage and the thermally controllable viscous fluid, whereby a user can exercise the appendage by moving the appendage through the fluid.

13. The rehabilitation device of claim 12 wherein the thermally controllable viscous fluid is selected from the group consisting of high fructose corn syrup, honey and glycerin.

14. A rehabilitation device for exercising a human appendage, the rehabilitation device comprising:

a fluid reservoir having an opening wherethrough a human appendage can be inserted into the reservoir;

a thermally controllable viscous fluid contained within the reservoir, the thermally controllable viscous fluid having a temperature and a viscosity;

a heating apparatus for increasing the temperature of the thermally controllable viscous fluid; and, a cooling apparatus for decreasing the temperature of the thermally controllable viscous fluid;

wherein the thermally controllable viscous fluid experiences an apparent change in viscosity when exposed to a change in temperature;

wherein the heating apparatus and the cooling apparatus are controllable for selectively increasing or decreasing the temperature, and thereby decreasing or increasing the viscosity, of the thermally controllable viscous fluid; and, wherein the thermally controllable viscous fluid is corn syrup and/or honey, and a user can exercise the appendage by moving the appendage through the fluid.

15. The rehabilitation device of claim 14 further comprising a deformable fluid impermeable material surrounding the appendage which prevents direct contact between the appendage and the thermally controllable viscous fluid.

16. A rehabilitation device for exercising a human appendage, the rehabilitation device comprising:

a fluid reservoir configured to receive a human appendage and having an opening wherethrough the human appendage can be inserted into the reservoir;

a thermally controllable viscous fluid contained within the reservoir, the thermally controllable viscous fluid having a temperature and a viscosity; and, a temperature control apparatus for selectively increasing or decreasing the temperature of the thermally controllable viscous fluid;

wherein the thermally controllable viscous fluid experiences an apparent change in viscosity when exposed to a change in temperature;

wherein the temperature control apparatus is controllable via a reversing valve for selectively increasing or decreasing the temperature, and thereby decreasing or increasing the viscosity, of the thermally controllable viscous fluid; and, wherein the thermally controllable viscous fluid is corn syrup and/or honey, and a user can exercise the appendage by moving the appendage through the fluid.

17. The rehabilitation device of claim 16, wherein the temperature control apparatus comprises:

a compressor which compresses a refrigerant;

an exterior coil disposed outside of the reservoir;

an interior coil disposed within the reservoir;

wherein the compressor, the exterior coil, and the interior coil are each in fluid communication with the reversing valve, and the exterior coil and the interior coil are in fluid connect with each other;

wherein the reversing valve can be selectively toggled between a cooling position and a heating position;

wherein, when the reversing valve is in the cooling position, compressed refrigerant is conveyed from the compressor first through the exterior coil and then through the interior coil for absorbing heat from the thermally controllable viscous fluid and thereby reducing the temperature thereof; and, wherein, when the control valve is in the heating position, compressed refrigerant is conveyed from the compressor first through the interior coil for transferring heat from the refrigerant to the thermally controllable viscous fluid and thereby increase the temperature thereof.

18. The rehabilitation device of claim 16 further comprising a deformable fluid impermeable material surrounding the appendage which prevents direct contact between the appendage and the thermally controllable viscous fluid.

19. A method of exercising a human appendage comprising the steps of:

immersing the appendage within a thermally controllable viscous fluid contained in a reservoir and having a temperature and a viscosity, wherein the thermally controllable viscous fluid experiences an apparent change in viscosity when exposed to a change in temperature;

selectively increasing and/or decreasing the temperature of the fluid with a temperature control apparatus and thereby decreasing and/or increasing its viscosity;

moving the appendage through the thermally controllable viscous fluid, whereby the thermally controllable viscous fluid provides resistance forces relative to the viscosity thereof for exercising the appendage; and, wherein the thermally controllable viscous fluid is corn syrup and/or honey, and a user can exercise the appendage by moving the appendage through the fluid.

* * * * *